US006379068B1

(12) United States Patent
Yu

(10) Patent No.: US 6,379,068 B1
(45) Date of Patent: Apr. 30, 2002

(54) COMPACT PEN

(76) Inventor: Wen-Ping Yu, 2 Fl., No. 19, Alley 1, Lane 11, Yah Jou Rd., Tu Cherng City, Taipei Hsien (TW)

( * ) Notice: Subject to any disclaimer, the term of this patent is extended or adjusted under 35 U.S.C. 154(b) by 0 days.

(21) Appl. No.: 09/968,872

(22) Filed: Oct. 3, 2001

(51) Int. Cl.[7] ..... B43K 5/16
(52) U.S. Cl. ..... 401/116
(58) Field of Search ..... 401/116, 68, 99

(56) References Cited

U.S. PATENT DOCUMENTS 2,951,465 A * 9/1960 Weisser et al. ..... 401/116
3,272,184 A * 9/1966 Crowley ..... 401/116
3,672,783 A * 6/1972 Bajusz ..... 401/116
3,792,931 A * 2/1974 Ganz ..... 401/116
5,048,991 A * 9/1991 Guo ..... 401/116

* cited by examiner

*Primary Examiner*—Charles R. Eloshway
(74) *Attorney, Agent, or Firm*—Rabin & Berdo, P.C.

(57) ABSTRACT

A compact pen has a top barrel, a controlling device securely mounted inside the top barrel, and a bottom barrel telescopically connected with the top barrel by means of threading engagement between the controlling device and the bottom barrel. An ink container having a tip is disposed inside the top barrel and the bottom barrel and further extends into the controlling device, whereby the tip is able to retract into the bottom barrel when not in use and the length of the compact pen is short in order to be conveniently carried around.

4 Claims, 3 Drawing Sheets

COMPACT PEN

BACKGROUND OF THE INVENTION

1. Field of the Invention

The present invention relates to a pen and more particularly to a compact pen having a controlling device. The controlling device has a hollow configuration to partially receive an ink container of the compact pen, and thereby the length of the compact pen is reduced in order to be conveniently carried around.

2. Description of Related Art

Pens are well known articles and there are numerous kinds of pen available in the market. A pen having a retractable tip is one of the kind that people widely use today. The pen with the retractable tip typically has a barrel, a cap connected to the barrel, a clip securely mounted on the cap, an ink container which has a tip and received in the barrel and the cap, and a controlling device disposed on top of the ink container to control the extension and retraction of the tip. A user is able to control the extension and retraction of the tip by turning the cap with respect to the barrel and whereby the tip is able to be retracted into the barrel when not in use whereby the pen can be conveniently carried around.

However, the pen with the retractable tip has the following shortcomings. To begin with, the length of the pen is desired to be short in order to fit in a pocket or a handbag. A common way to achieve this goal is to shorten the ink container, and therefore the barrel and the cap which together receive the ink container are able to be shortened correspondingly. Although shortening the ink container is able to shorten the length of the pen, the quantity of ink contained in the ink container is also reduced and causes a reduction in the operating life of the ink container. Secondly, the clip of the pen is usually connected to the cap by welding, and may easily break or crack along a welding line after a period of time.

Therefore, the present invention tends to provide a compact pen to mitigate or obviate the aforementioned problems.

SUMMARY OF THE INVENTION

An objective of the present invention is to provide a compact pen such that the length of the compact pen is short in order to be conveniently carried around.

Another objective of the present invention is to provide a compact pen having a clip integrally formed and mounted onto a cap of the pen so the clip is durable and not easily broken or cracked.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
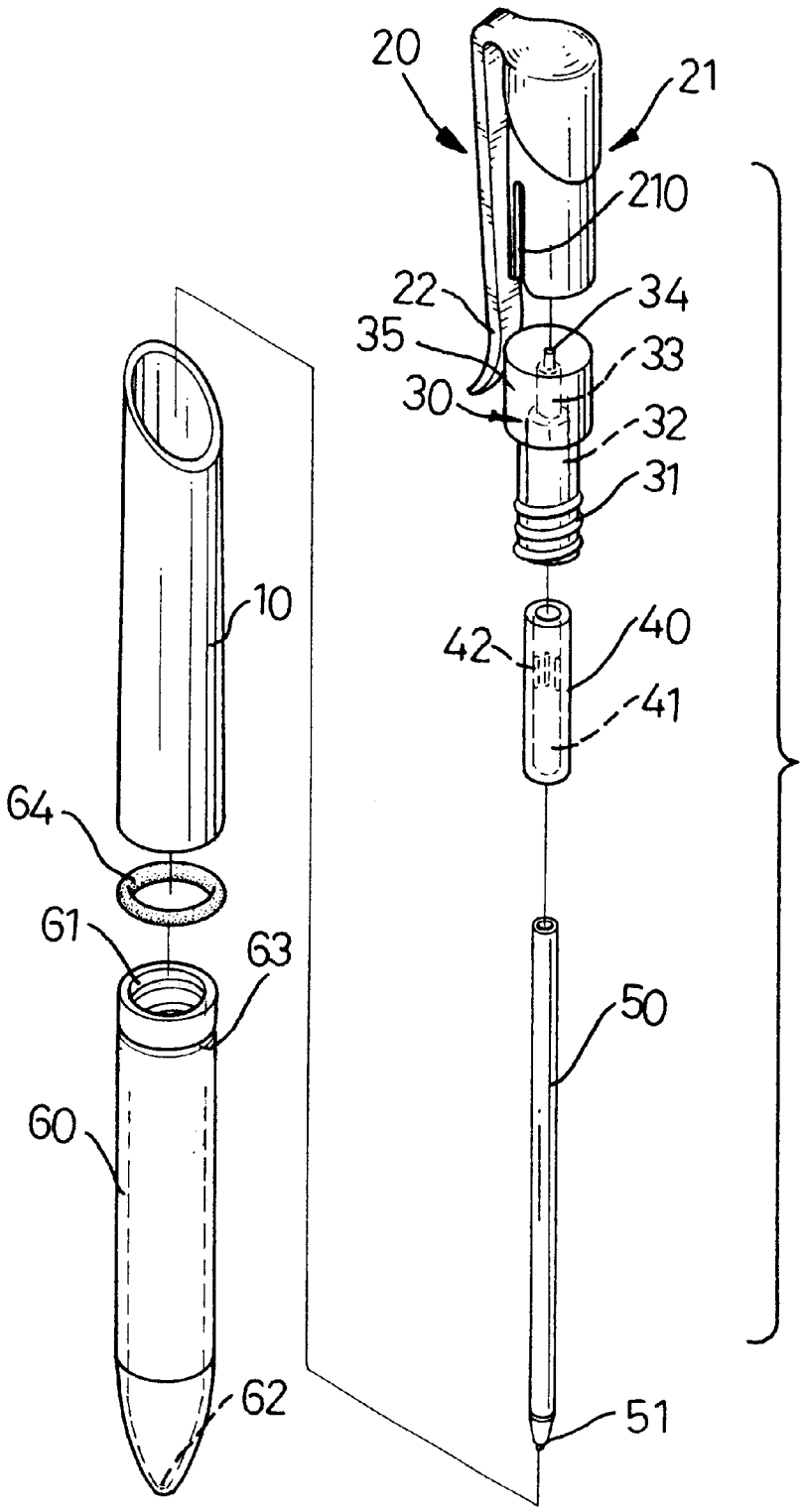
FIG. 1 is an exploded perspective view of a compact pen in accordance with the present invention.

With reference to FIG. 1, a compact pen in accordance with the present invention has a top barrel (10), a cap (20), a controlling device (30), a sleeve (40), an ink container (50), and a bottom barrel (60).

Figure 2:
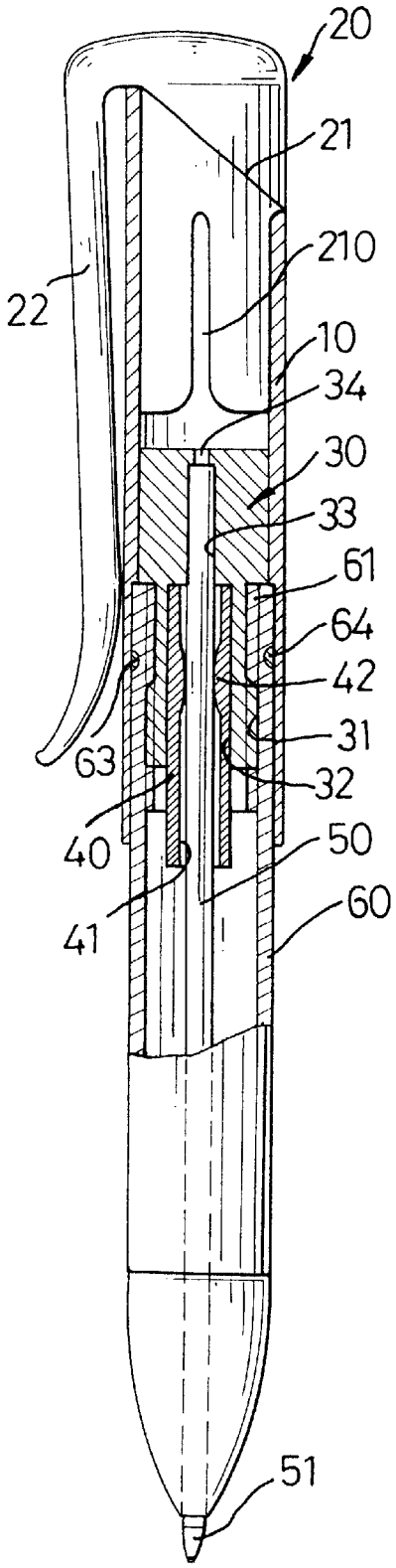
FIG. 2 is a cross-sectional view of the compact pen in FIG. 1 when a tip of the pen is extended out of a barrel of the pen.

With reference to FIGS. 1 and 2, the top barrel (10) has a tube configuration. The cap (20) has a connecting portion (21) and a clip (22). The connecting portion (21) is a tube configured to be force fitted inside the top barrel (10). A cutout (210) is defined at a bottom end of the connecting portion (21) that is to be received in the top barrel (10) and the cutout (210) extends along a longitudinal direction of the connecting portion (21) to provide resilience to allow the connecting portion (21) to be force fitted with the top barrel (10). The clip (22) integrally extends from a top end of the connecting portion (21) and along a side of the connecting portion (21).

The controlling device (30) is configured to be received in the top barrel (10), and has a threaded portion (31) and a head portion (35) configured to be force fitted with the top barrel (10). A sleeve hole (32) configured corresponding to the sleeve (40) is defined in a bottom surface of the controlling device (30) and extends along the threaded portion. A receiving hole (33) configured corresponding to the ink container (50) is further defined in the controlling device (30) and communicates with the sleeve hole (32). A pressure hole (34) is defined in a top surface of the controlling device (30) and communicates with the receiving hole (33) to balance the pressure inside the controlling device (30) to the air.

The sleeve (40) is configured to be force fitted in the sleeve hole (31), and longitudinally defines a through hole (41). The through hole (41) is configured to allow the ink container (50) to extend through the through hole (41). Multiple retaining pieces (42) are formed in an inner surface defining the through hole (41) to clamp the ink container (50).

The bottom barrel (60) has a tube configuration with an open top end and a conical bottom end. An inner surface of the bottom barrel (60) near the open top end is formed as a threaded surface (61) to mate with the threaded portion (31) of the controlling device (30). An annular groove (63) is defined around the bottom barrel (60) and near the open top end to receive an elastic ring (64). An aperture (62) is defined in the conical bottom end to allow a tip (51) of the container (50) to extend out of or to retract into the bottom barrel (60).

When assembling the compact pen, the connecting portion (21) of the cap (20) is force fitted into a top end of the top barrel (10). The cutout (210) provides the resilience which makes this fitting procedure smooth and ensures secure holding between the cap (20) and the top barrel (10). The ink container (50) extends through the sleeve (40) via the through hole (41) and is clamped by the multiple retaining pieces (42) of the sleeve (40). The sleeve (40) is then force fitted into the sleeve hole (32) defined in the controlling device (30) and the ink container (50) extends into receiving hole (33) defined in the controlling device (30). The controlling device (30) is further mounted inside the top barrel (10) by force fitting the head portion (35) of the controlling device (30) into the top barrel (10). Finally, the bottom barrel (60) and the top barrel (10) are connected together by extending the open top end of the bottom barrel (60) into the top barrel (10) and mating of the threaded surface (61) of the bottom barrel (60) with the threaded portion (31) of the controlling device (30).

Figure 3:
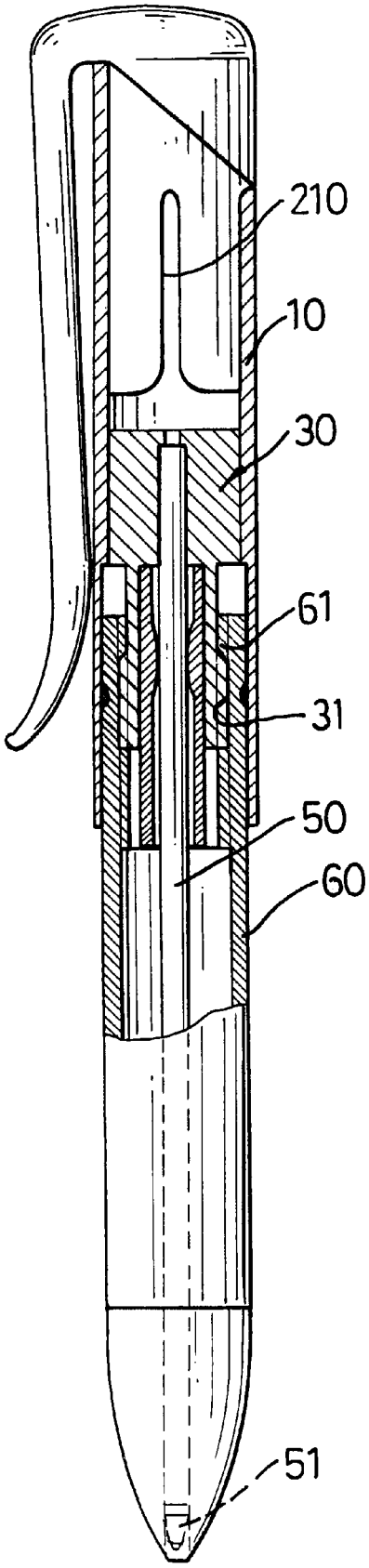
FIG. 3 is a cross-sectional view of the compact pen in FIG. 1 when the tip is retracted into the barrel.

With reference to FIGS. 2 and 3, when turning the top barrel (10) in a direction with respect to the lower barrel (60), the bottom barrel (60) extends more into the top barrel (10) and thereby allows the tip (51) of the container (50) to extend out of the lower barrel (60) via the aperture (62). When turning the top barrel (10) in an opposite direction, the bottom barrel (60) extends less into the top barrel (10) and the tip (51) of the container (50) retracts into the lower barrel (60).

From the above description, it is noted that the invention has the following functions and advantages:

1. compact size. The controlling device (30) has a hollow configuration to partially receive the ink container (50). Therefore, the length of the compact pen is short and enables the compact pen to be conveniently carried around.
2. durable clip. The clip (22) is integrally formed in the cap (20) and not easily broken or cracked as compared to those conventional clips which are connected to caps by welding.

While this invention has been particularly shown and described with references to preferred embodiment thereof, it will be understood by those skilled in the art that various changes in form and details may be made therein without departing from the scope of the invention encompassed by the appended claims.

What is claimed is:

1. A compact pen comprising:

a bottom barrel having a top opening, an aperture oppositely defined with respect to the top opening, and a threaded surface formed in an inner surface of the bottom barrel near the top opening;

a controlling device having a threaded portion, and the threaded portion threadingly engaged with the threaded surface of the bottom barrel;

an ink container movably received in the bottom barrel and securely connected to the controlling device, the ink container having a tip selectively extending out from the aperture of the bottom barrel; and, a sleeve force fitted into a sleeve hole defined in the controlling device, the sleeve defining a through hole, a receiving hole communicating with the sleeve hole and a pressure hole communicating the receiving hole with the air for balancing the pressure inside the through hole and the receiving hole with the air, multiple retaining pieces are formed in an inner surface defining the through hole so as to securely clamp the ink container which partially extends into the receiving hole between the retaining pieces.

2. The compact pen as claimed in claim 1 further comprising a top barrel receiving therein the controlling device and having a bottom end telescopically extending into the bottom end of the top barrel.

3. The compact pen as claimed in claim 2 further comprising a cap securely connected to a top end of the top barrel by force fitting and provided with a clip integrally formed with the cap.

4. The compact pen as claimed in claim 3, wherein the cap defines a cutout to provide resilience to the cap.

* * * * *